US007973622B2

(12) United States Patent
Yang et al.

(10) Patent No.: US 7,973,622 B2
(45) Date of Patent: Jul. 5, 2011

(54) APPARATUS FOR AUXILIARY CONTACT OF CIRCUIT BREAKER

(75) Inventors: Hong Ik Yang, Chungcheongbuk-do (KR); Sang Chul Lee, Chungcheongbuk-do (KR); Kil Young Ahn, Daejeon (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 458 days.

(21) Appl. No.: 12/194,971

(22) Filed: Aug. 20, 2008

(65) Prior Publication Data

US 2009/0051470 A1 Feb. 26, 2009

(30) Foreign Application Priority Data

Aug. 20, 2007 (KR) ..... 10-2007-0083567

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/20*** | (2006.01) |
| ***H01H 3/00*** | (2006.01) |
| ***H01H 9/00*** | (2006.01) |

(52) U.S. Cl. ..... 335/13; 335/167; 335/185; 335/189; 335/190; 335/192; 200/308; 200/318; 200/318.1; 200/329; 200/330; 200/337; 200/573

(58) Field of Classification Search ..... 335/6–46, 335/106, 141, 156, 167–176, 185–195; 200/308, 200/309, 312, 318, 318.1, 318.2, 329, 330, 200/337, 400–401, 546, 566, 573
See application file for complete search history.

(56) References Cited

U.S. PATENT DOCUMENTS

| | | | | |
|---|---|---|---|---|
| 2,868,921 | A * | 1/1959 | Rigert | 335/192 |
| 2,922,005 | A * | 1/1960 | Cameron et al. | 335/28 |
| 3,217,125 | A * | 11/1965 | Brackett | 337/64 |
| 3,309,636 | A * | 3/1967 | Price | 335/155 |
| 3,651,436 | A * | 3/1972 | Cooper et al. | 335/13 |
| 4,524,339 | A * | 6/1985 | Chabot | 335/22 |
| 4,635,013 | A * | 1/1987 | Lemarquand et al. | 335/20 |
| 5,823,323 | A * | 10/1998 | Seymour et al. | 200/308 |
| 6,040,746 | A * | 3/2000 | Maloney et al. | 335/13 |
| 7,385,153 | B1 * | 6/2008 | Bogdon et al. | 200/303 |
| 7,800,468 | B2 * | 9/2010 | Bogdon et al. | 335/202 |
| 2010/0282583 | A1 * | 11/2010 | Regantini et al. | 200/329 |

* cited by examiner

*Primary Examiner* — Anh T Mai
*Assistant Examiner* — Mohamad A Musleh
(74) *Attorney, Agent, or Firm* — Lee, Hong, Degerman, Kang & Waimey

(57) ABSTRACT

An apparatus for auxiliary contact of circuit breaker is disclosed that is capable of preventing an erroneous operation of and damage to an ON/OFF switch caused by over-stroke of a linkage mounted at an auxiliary contact apparatus, and enhancing reliability despite repeated opening/closing thereof.

6 Claims, 11 Drawing Sheets

APPARATUS FOR AUXILIARY CONTACT OF CIRCUIT BREAKER

CROSS-REFERENCE TO RELATED APPLICATIONS

Pursuant to 35 U.S.C. §119(a), this application claims the benefit of earlier filing date and right of priority to Korean Patent Application No. 10-2007-0083567, filed on Aug. 20, 2007, the contents of which is incorporated by reference herein in its entirety.

TECHNICAL FIELD

The following description relates generally to a circuit breaker, and more particularly to an apparatus for auxiliary contact of circuit breaker capable of preventing an erroneous operation of and damage to an ON/OFF switch caused by over-stroke of a linkage mounted at the apparatus for auxiliary contact of circuit breaker, and enhancing reliability despite repeated opening/closing thereof.

BACKGROUND ART

Generally, a circuit breaker is an electric protecting apparatus mounted between an electric source and load units for protection of load units such as a motor and a transformer and an electric line from an abnormal current (a large current caused by i.e., short circuit and ground fault) generated at an electric circuit such as a power transmission/distribution line and private power transforming facilities. In other words, a circuit breaker is an automatic electrical switch that stops or restricts the flow of electric current in a sudden overloaded or otherwise abnormally stressed electrical circuit. A circuit breaker provides automatic current interruption to a monitored circuit when undesired over-current conditions occur. The over-current condition includes, for example, arc faults, overloads, ground faults, and short-circuits.

Furthermore, the circuit breaker may manually open or close the electric line under normal use state, and open or close the line from a remote distance using an electric manipulation unit outside a metal container and automatically break the line during over-current and short-circuit to protect the power facilities and load units.

In order to break the electric line, the air circuit breaker is equipped with a stationary contactor and a movable contactor at a breaking mechanism where a current is made to flow in normal situation by connecting the stationary contactor and the movable contactor, and when there occurs a flaw at any portion of the line to allow flowing a large current, the movable contactor is instantly separated from the stationary contactor to open the circuit, thereby interrupting the flow of the large current.

Meanwhile, a circuit breaker may be classified into an air circuit breaker, a hydraulic circuit breaker and a spring circuit breaker in accordance with manipulation method. In addition, the circuit breaker may be classified into an air circuit breaker (ACB), and a gas circuit breaker (GCB) in accordance with used arc extinguishing medium, and even in this case, a similar effect is achieved.

The circuit breaker is typically mounted with a separate auxiliary contact apparatus, which is a device for transmitting a signal to outside according to opening/closing of a breaker mechanism, i.e., connection and breaking of a movable contactor and a stationary contactor.

Now, an apparatus for auxiliary contact of circuit breaker (hereinafter referred to as auxiliary contact apparatus) is explained in more detail.

When an electric line under a normal use is conducted, an indicator connected to the auxiliary contact device indicates a connected state, in which case a movable contactor is connected to a stationary contactor. However, when there occurs a flaw at any portion of the line to allow flowing a large current caused by, for example, short circuit or ground fault, an open/close mechanism that is driven by a detector signal detecting the abnormal current is activated to rotate an open/close axis, and the movable contactor is instantly separated from the stationary contactor in response to the rotation of the open/close axis to open the circuit, thereby interrupting the flow of the large current. An ON/OFF switch of the auxiliary contact apparatus is turned on and off by a linkage communicating with the open/close axis, and an outside indicator connected to the ON/OFF switch indicates that the circuit breaker is interrupted.

FIG. 1 is a perspective view illustrating an external look of a body of a typical circuit breaker, FIG. 2 is a perspective view illustrating an auxiliary contact apparatus according to an exemplary implementation, FIG. 3 is a lateral view illustrating a released position of the auxiliary contact apparatus of FIG. 2, and FIG. 4 is a lateral view illustrating a compressed position of the auxiliary contact apparatus of FIG. 2.

Although a body of the conventional circuit breaker is not shown in the drawings, the body 10 includes a detector for detecting an accidental current when the accidental current occurs, an open/close mechanism 20 that is driven by a detection signal of the detector, and an open/close axis 30 rotating by being communicated with the open/close mechanism 20, as depicted in FIG. 1.

The body 10 is also mounted therein with a breaker mechanism comprising a stationary contactor and a movable contactor that are mutually connected or interrupted by the rotation of the open/close axis 30 to open or close a conducted electric line. The body 10 further includes an arc distinguishing device distinguishing the arc that is generated on the movable contactor when various internal loads are interrupted.

Particularly, the body 10 is mounted with an external indicator indicating connection and interruption states of the conducted line in response to the rotation of the open/close axis 30, i.e., an auxiliary contact apparatus 40 notifying the connection and interruption states via a lamp or a buzzer.

Referring to FIG. 2, the conventional auxiliary contact apparatus 40 includes a push bar 52 that operates horizontally and vertically by being connected to the open/close axis 30, a drive rotation link 54 rotated by the push bar 52 about a driving shaft 56, and a linkage 50 of a driven rotation link 58 extensively formed from the driving shaft 56 toward a radial direction. An ON/OFF switch 42 of the auxiliary contact apparatus 40 is compressed or released by the activation of the driven rotation link 58 for on and off operation, whereby connection or interruption of the circuit breaker is indicated on the outside indicator.

Referring to FIG. 3, when the convention line is conducted, the stationary contactor and the movable contactor inside the body 10 are connected to cause the open/close axis 30 to rotate clockwise. As a result, the push bar 52 connected to the open/close axis 30 does not push the drooped drive rotation link 54, where the driven rotation link 58 does not compress the ON/OFF switch 42 and is in the state of being released without the rotation of the driving shaft 56. The external indicator connected to ON/OFF switch 42 indicates that the circuit breaker is in the connected state.

However, as shown in FIG. 4, if the accidental current is detected to cause the circuit breaker to be in the interrupted state, the movable contactor is separated from the stationary contactor to allow the open/close axis 30 to rotate counter-clockwise. Resultantly, the push bar 52 connected to the open/close axis 30 is pushed upward to allow the drive rotation link 54 to push the push bar 52. Successively, the driving shaft 56 is rotated along by the rotation of the drive rotation link 54 to rotate the driven rotation link 58 counter-clockwise. In doing so, the rotation of the driven rotation link 58 compresses the ON/OFF switch 42 to allow the external indicator connected to the ON/OFF switch 42 to indicate that the circuit breaker is interrupted.

Meanwhile, a strong impact is generated by the operation of the open/close mechanism 20 during interrupting operation of the breaker mechanism, whereby the open/close axis 30 is excessively rotated, the rotational power of which is transmitted to each link. Furthermore, the rotational force transmitted to the driven rotation link 58 is strongly transmitted to the ON/OFF switch 42 as an impact force. The excessive rotation of the open/close axis 30 brings about an over-stroke of the push bar 52 to cause the linkage 50 rotate beyond an established rotational radius. In the end, the impact caused by the over-stroke is transmitted intact to the ON/OFF switch 42 that is compressed or released by the driven rotation link 58.

As noted from the foregoing, there are problems in the conventional auxiliary contact apparatus in the circuit breaker in that the ON/OFF switch may be damaged or destructed by the over-stroke from the operation of the linkage communicating with the open/close axis. This inevitably leads to an erroneous operation and degraded reliability of the auxiliary contact apparatus caused by the repeated on-off operation thereof.

Technical Problem

The present novel concept is provided in view of the above problems, and the above discussed and other drawbacks and deficiencies of the prior art are overcome or alleviated by an auxiliary contact apparatus for circuit breaker capable of preventing erroneous operation of and damage to an ON/OFF switch caused by over-stroke of a linkage mounted at an auxiliary contact, and enhancing reliability despite repeated opening/closing thereof.

The foregoing and other objects, features, aspects and advantages of the present invention will become more apparent from the following detailed description of the present inventive concept and exemplary implementations when taken in conjunction with the accompanying drawings.

Technical Solution

In one general aspect for accomplishing the object, an auxiliary contact apparatus comprises: an open/close axis rotating in response to the operation of an open/close mechanism mounted at a body of the circuit breaker to connect and interrupt a conducted current; an auxiliary contact unit mounted at the body and equipped with an ON/OFF switch electrically connected to an external indicator; a cam driving shaft rotatably mounted at a front side of the ON/OFF switch of the auxiliary contact unit; a driving cam formed along a radial direction of the cam driving shaft for turning on and off the ON/OFF switch by allowing a maximum head profile to compress and release the ON/OFF switch in response to the rotation of the cam driving shaft; and a linkage connecting the open/close axis and the cam driving shaft for rotating the cam driving shaft in response to the rotation of the open/close axis.

Implementations of this aspect may include one or more of the following features.

The linkage may include a drive rotation link extensively formed from one side of the open/close axis toward the radial direction for rotating along with the open/close axis; a coupler link rotatably coupled at one end thereof to the drive rotation link; and a driven rotation link rotatably coupled at one end thereof to the other end of the coupler link, where the other end is rotatably coupled to the cam driving shaft.

The apparatus may further comprises a stopper lug protrusively formed at one surface of the driven rotation link contacting the coupler link for stopping the rotation of the driven rotation link and the coupler link relative to a compression position on which the maximum head profile of the driving cam compresses the ON/OFF switch in response to the rotation of the driven rotation link and a release position on which the maximum head profile of the driving cam releases the compression of the ON/OFF switch.

The auxiliary contact unit may include a plurality of switch frames for accommodating a plurality of ON/OFF switches; and a bracket attachably and releasably fixing the plurality of switch frames, where one side thereof is coupled to the body of the circuit breaker.

The bracket may include a pair of stationary ribs so formed as to allow both ends of the cam driving shaft to be rotatably coupled.

The bracket may be piercingly formed with a plurality of stationary grooves, and the plurality of switch frames is formed at one surface thereof with stationary lugs in which the plurality of stationary grooves can be insertedly fixed and slidably coupled along a surface contacted by each adjacent frame.

The cam driving shaft may have a multi-angled cylindrical shape, and the driving cam is rotated along with the cam driving shaft by allowing the cam driving shaft to be hooked up inside a hollow hole.

Advantageous Effects

The auxiliary contact of circuit breaker according to the instant inventive concept is such that a linkage is linked to a cam driving shaft and a driving cam to allow an ON/OFF switch being compressed only by the maximum head of the driving cam, thereby preventing an erroneous operation of and damage to the ON/OFF switch caused by over-stroke of the linage mounted at the auxiliary contact apparatus and enhancing reliability despite the repeated opening and closing of the auxiliary contact apparatus.

Furthermore, a driven rotation link may be formed with a stopper lug to enable the linkage to stop at a precise position without running idle when conducted electrical lines are connected or interrupted, i.e., when the ON/OFF switch is compressed and released by the maximum head profile of the driving cam, thereby minimizing impact transmitted to each link.

Still furthermore, configurations of switch frames and bracket may be changed to solidify the fixation of the ON/OFF switch, whereby a compact auxiliary contact apparatus can be embodied within a cramped space of the circuit breaker.

BEST MODE

Figure 1:
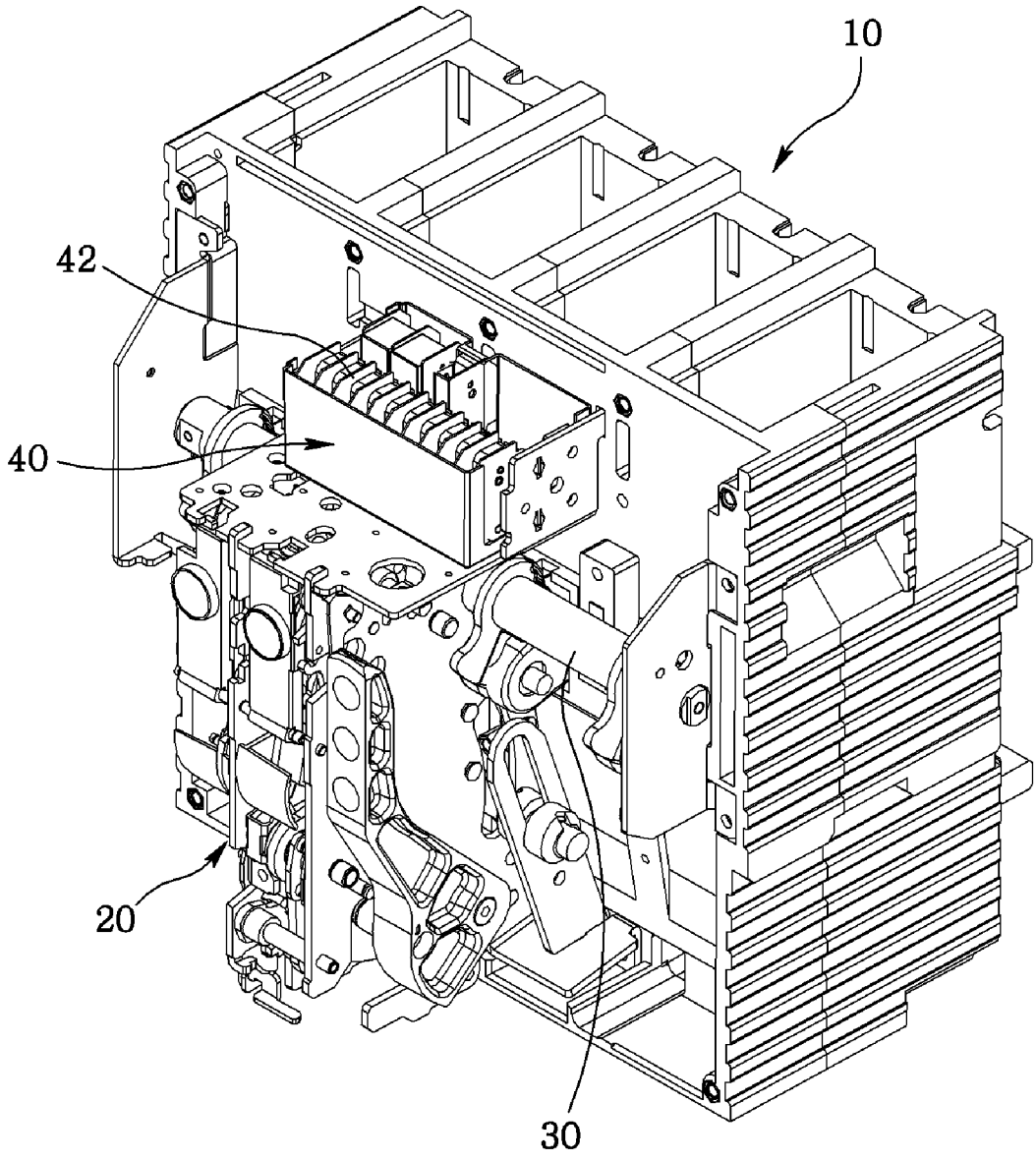
FIG. 1 (Prior Art)
FIG. 1 is a perspective view illustrating an external look of a body of a typical circuit breaker.
Figure 2:
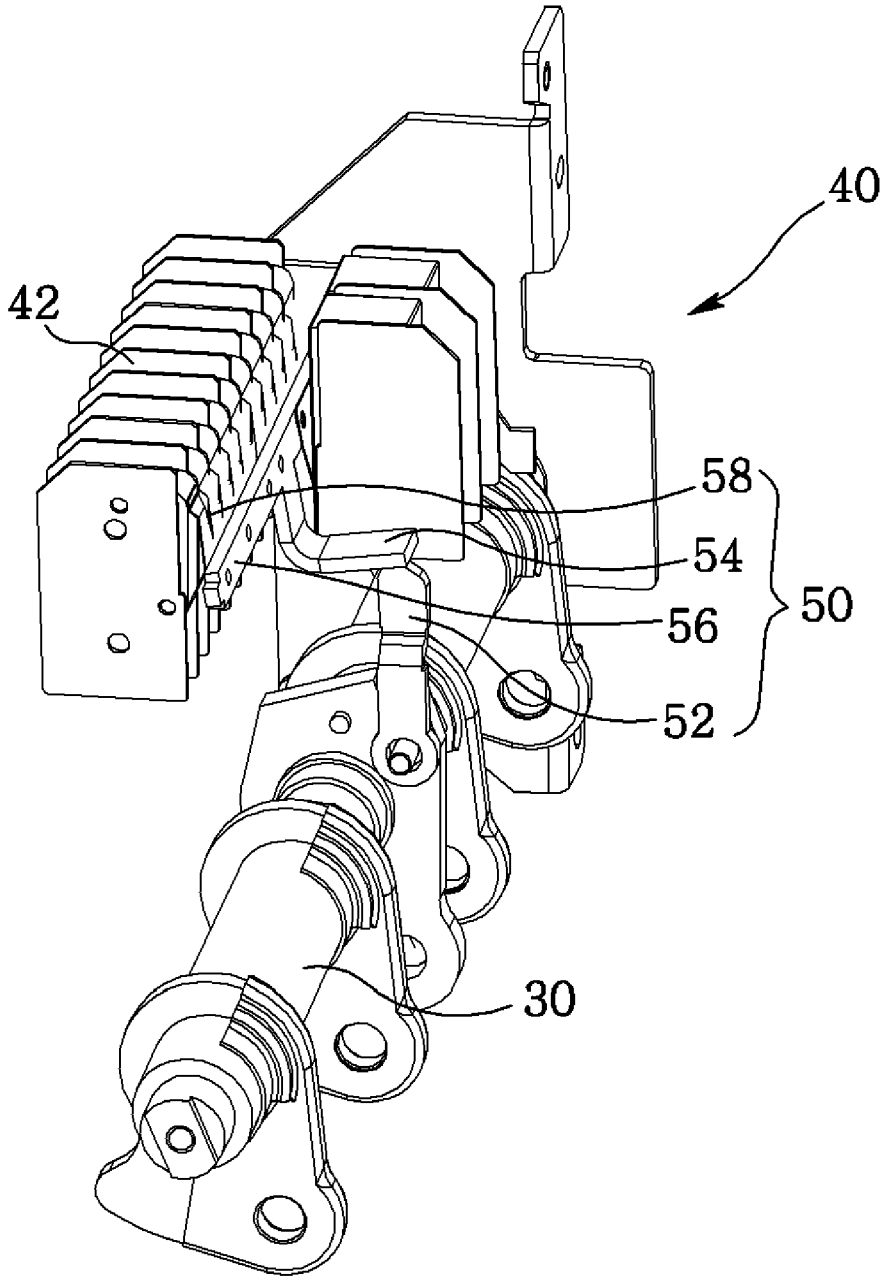
FIG. 2 (Prior Art)
FIG. 2 is a perspective view illustrating an auxiliary contact apparatus according to an exemplary implementation.
Figure 3:
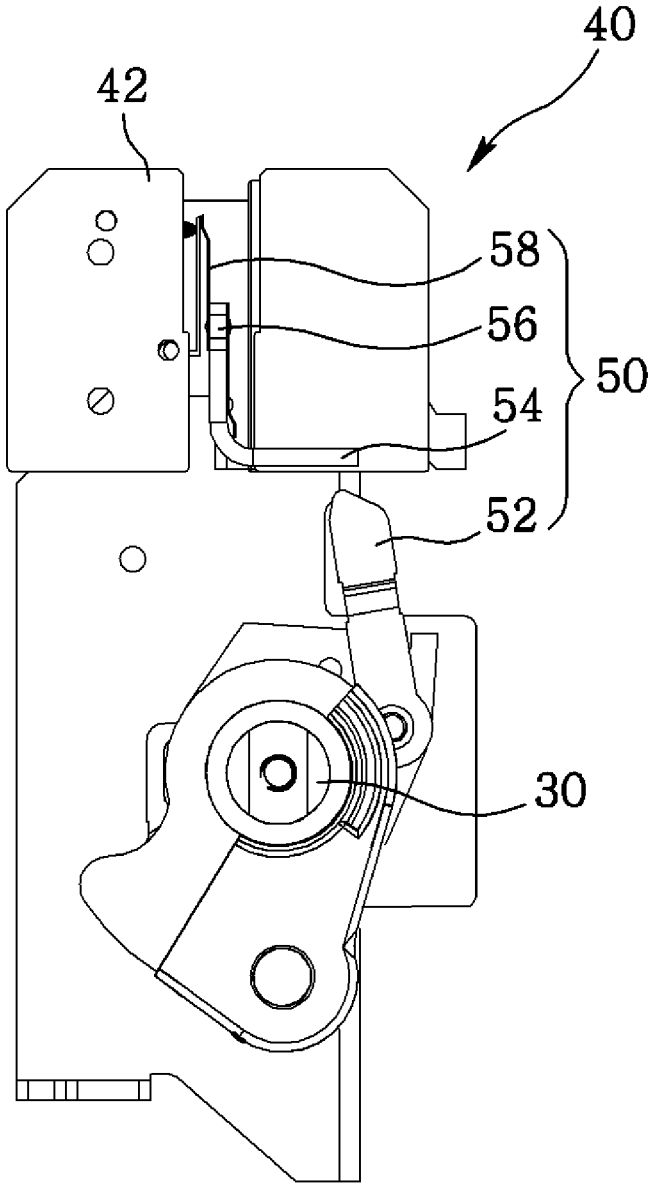
FIG. 3 (Prior Art)
FIG. 3 is a lateral view illustrating a released position of the auxiliary contact apparatus of FIG. 2.
Figure 4:
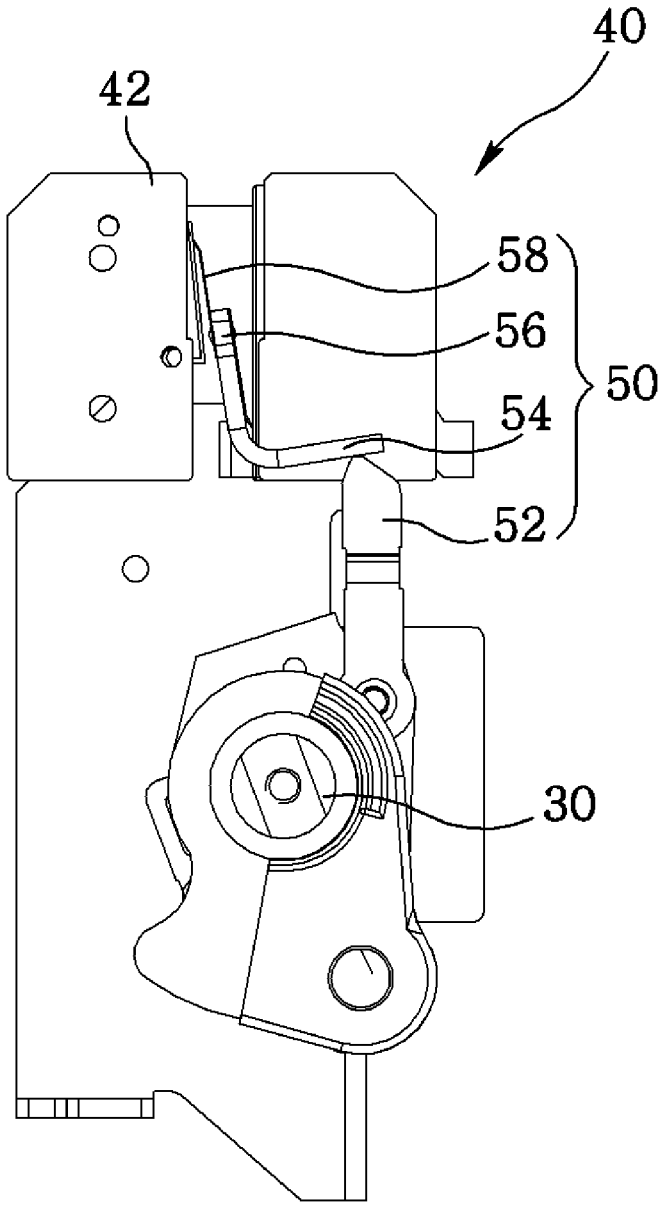
FIG. 4 (Prior Art)
FIG. 4 is a lateral view illustrating a compressed position of the auxiliary contact apparatus of FIG. 2.

Exemplary implementations of an auxiliary contact apparatus of circuit breaker according to the present novel concept will be described in detail with reference to the accompanying drawings.

Referring to FIGS. 5 to 11, an auxiliary contact apparatus of circuit breaker according to the present disclosure may include an open/close axis 100 rotating in response to the operation of an open/close mechanism 20 mounted at a body 10 of the circuit breaker, an auxiliary contact unit 200, a cam driving shaft 300, a driving cam 400 and a linkage 500.

The auxiliary contact unit 200 may include an ON/OFF switch 220, a switch frame 240 and a bracket 260, and the linkage 500 may include a driving rotation link 520, a coupler link 540 and a driven rotation link 560.

Figure 5:
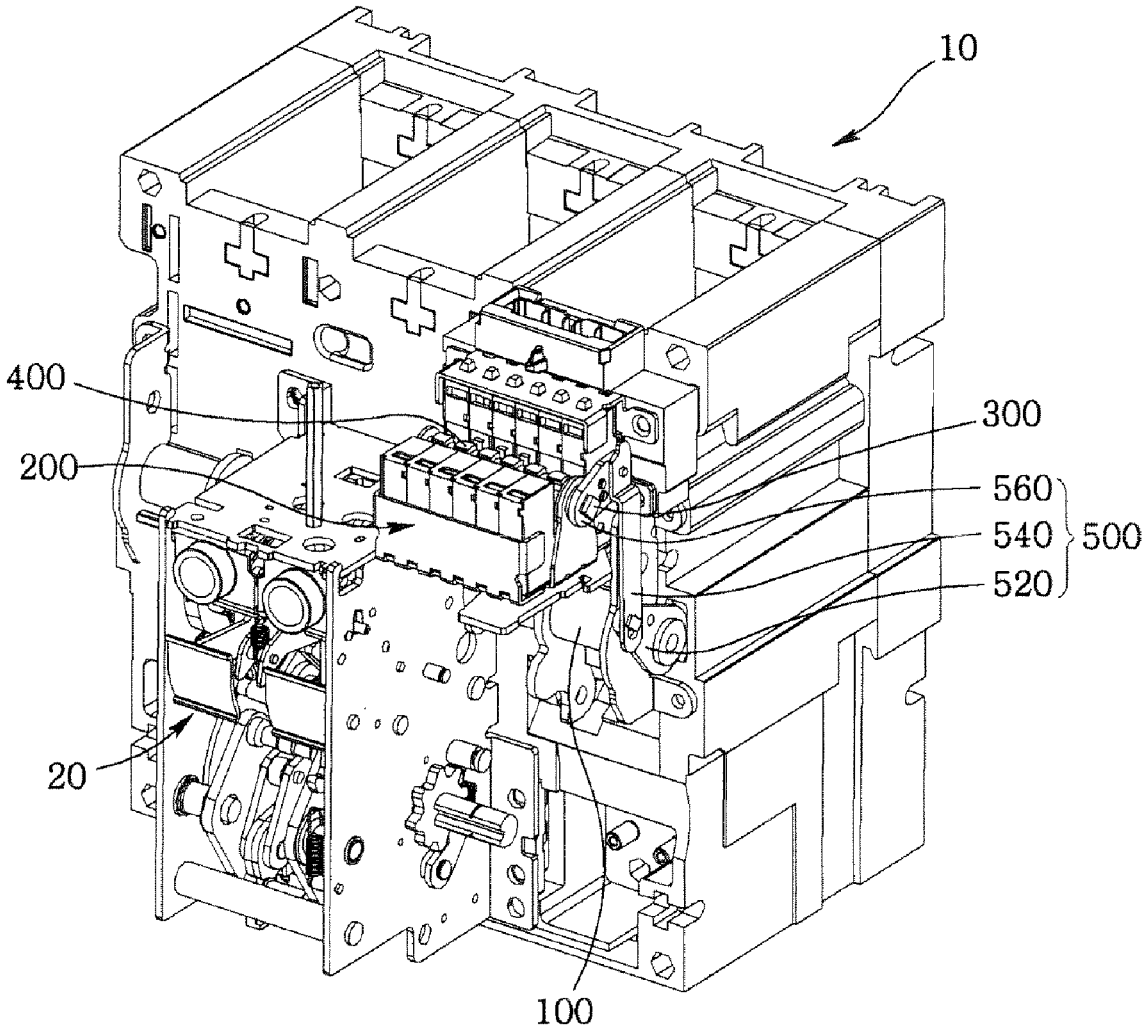
FIG. 5 is a perspective view illustrating an auxiliary contact apparatus mounted at a body of a circuit breaker according to an exemplary implementation.

The body 10 of the circuit breaker of FIG. 5 showing a state removed of a cover of the circuit breaker must be solidly manufactured so as to be supportively mounted with various constitutional elements. Various constitutional elements that are supposed to be mounted on the body 10 of the circuit breaker include a breaker mechanism composed of a stationary contactor and a movable contactor, the open/close mechanism 20 for operating the breaker mechanism and various internal loads having respective functions. The body 10, the open/close mechanism 20 and various constitutional elements mounted at the body 10 may be embodied by the prior art techniques, so that there will be specific elaborated description thereto.

Because the auxiliary contact apparatus of circuit breaker is to prevent an erroneous operation of and damage to an ON/OFF switch caused by over-stroke of a linkage mounted at an auxiliary contact mechanism, and enhance reliability despite repeated opening/closing thereof, there will be hereinafter detailed description of constitutional elements of the auxiliary contact apparatus.

Referring to FIG. 5, the open/close axis 100 may be rotated in response to the operation of the open/close mechanism 20 mounted at the body 10 to connect or interrupt the conducted current. In other words, the open/close axis 100 communicates with the open close mechanism 20 to rotate clockwise or counter-clockwise, whereby a movable contactor mounted inside the body 10 is connected to or separated from a stationary contactor by the rotation of the open/close axis 100. When the movable contactor is connected to the stationary contactor, a normal current is in the conducted state, but when the movable contactor is separated from the stationary contactor, the conducted current is in the state of being interrupted. In other words, the conducted current is in a connected or interrupted state by the rotation of the open/close axis 100.

Referring again to FIG. 5, the auxiliary contact unit 200 mounted at the body 10 of the circuit breaker is disposed with the ON/OFF switch 220 electrically connected to an external indicator. The auxiliary contact unit 200 is such that the ON/OFF switch 220 is connected to an external indicator, i.e., a warning lamp or a buzzer, and turned on and off by the driving cam 400 (described later). As a result, the external indicator may enable an easy check of a current state of the circuit breaker via the light of the lamp or a warning sound of the buzzer.

Referring again to FIG. 5, the auxiliary contact unit 200 may include a plurality of switch frames 240 accommodated by a plurality of ON/OFF switches and a bracket 260 attachably and detachably fixing the plurality of switch frames 240 while being coupled to the body 10 at one side thereof.

The ON/OFF switch 220 refers to a typical micro-switch opening and closing an electrical circuit, where a button is pressed by rotation of a rotating lever to allow the ON/OFF switch to turn on or turn off the electrical circuit. The ON/OFF switch 220 is accommodated to the switch frame 240 in order to protect the circuit breaker against the impact generated in the course of interruption operation of the circuit breaker.

Mode for Invention

Figure 9:
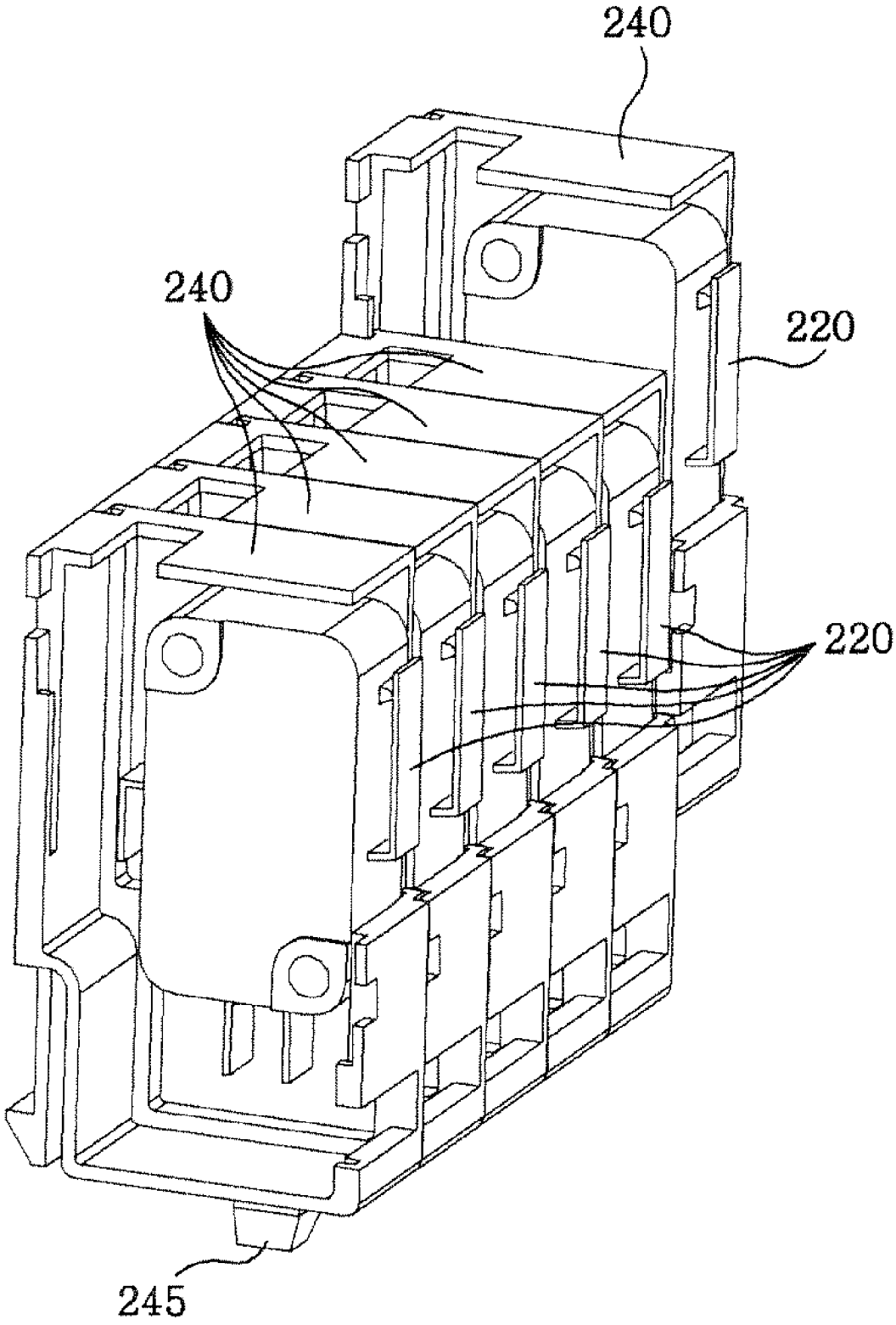
FIG. 9 is a perspective view illustrating an ON/OFF switch and a switch frame of the auxiliary contact apparatus according to the exemplary implementation of FIG. 6.

Now, referring to FIG. 9, the ON/OFF switch may comprise a plural structure and be accommodated to the plurality of switch frames 240. The switch frames 240 may be so formed as to open the button and rotating lever of the ON/OFF switches 220. The switch frames are slidably coupled along a surface contacted by each adjacent switch frame.

The sliding coupling refers to a coupling via a protruded guidance unit for insertion into a slit or a groove by forming the slit or the groove at one surface facing each other, as illustrated in FIG. 9. The slidable coupling of the switch frames 240 may enable a more precise arrangement of the ON/OFF switches 220. The switch frames 240 may be attachably and detachably fixed to the bracket 260. The attachable and detachable fixation of the switch frames 240 to the bracket 260 may be accomplished by use of fixation hooks as shown in FIG. 9.

Figure 10:
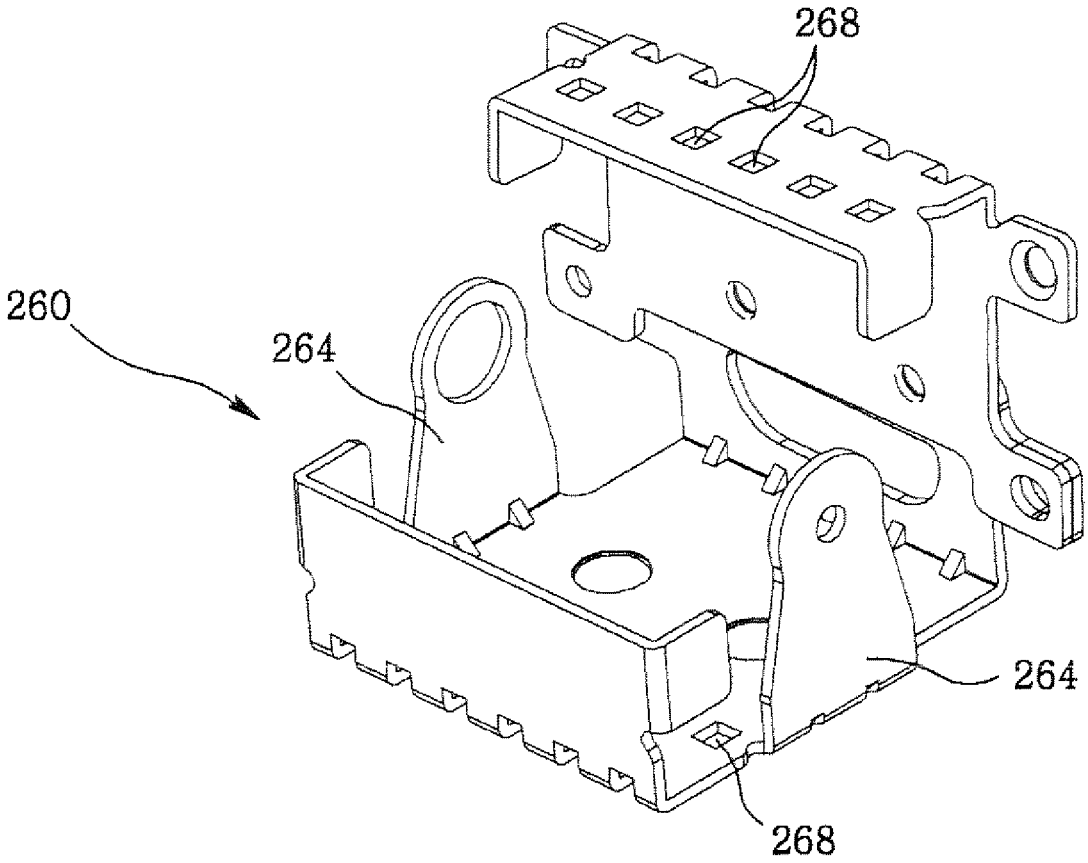
FIG. 10 is a perspective view illustrating a bracket of the auxiliary contact apparatus according to the exemplary implementation of FIG. 6.

The bracket 260 serves to fix the switch frames 240 functions to fix the switch frames 240 and are piercingly formed with a plurality of stationary grooves 268 for fixing the switch frames 240 at correct positions, as shown in FIG. 10. The switch frames 240 are formed at one surface thereof with stationary lugs 245 so as to be insertedly fixed into the plurality of stationary grooves 268. The bracket 260 is coupled at one end thereof to the body 10 of the circuit breaker to thereby support the auxiliary contact unit 200. Meanwhile, the breaker 260 may include a pair of stationary ribs 264 for rotatably coupling both ends of the cam driving shaft (described later. 300).

Figure 6:
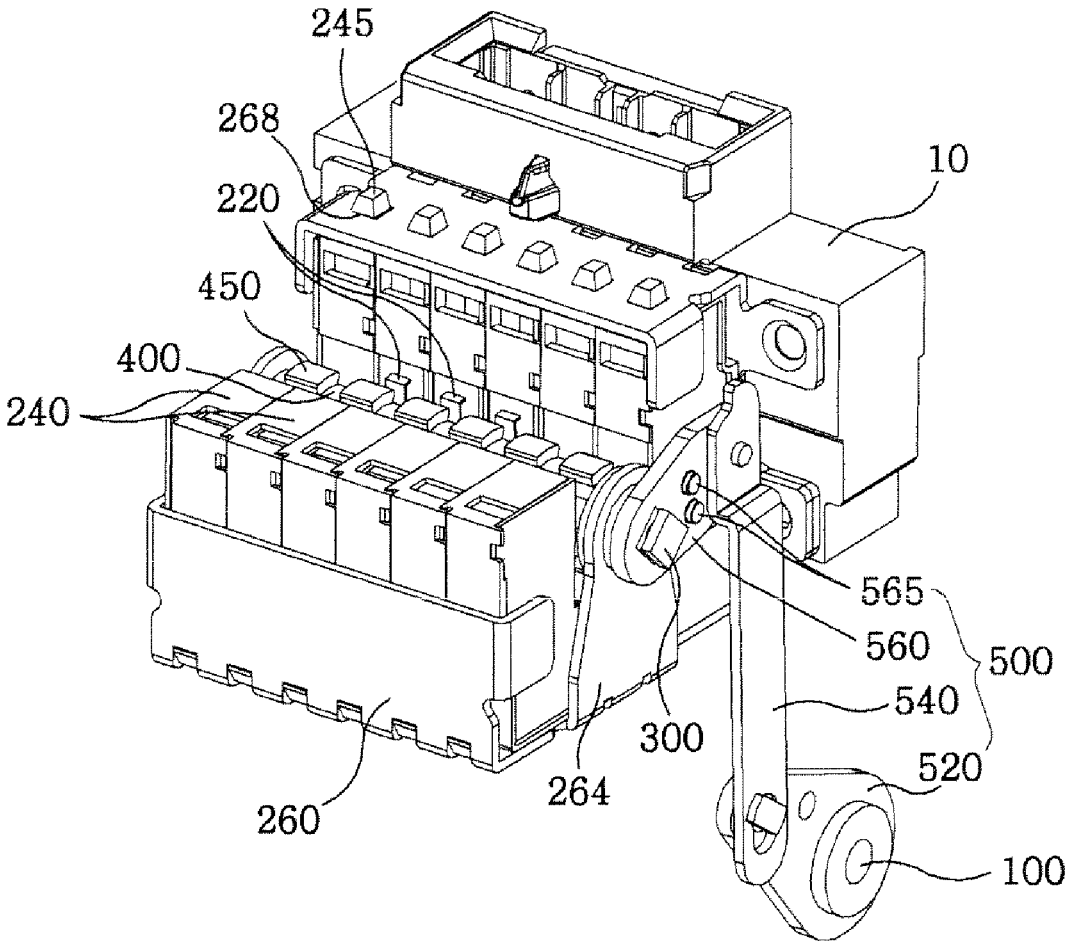
FIG. 6 is a perspective view illustrating the auxiliary contact apparatus according to the exemplary implementation of FIG. 5.
Figure 7:
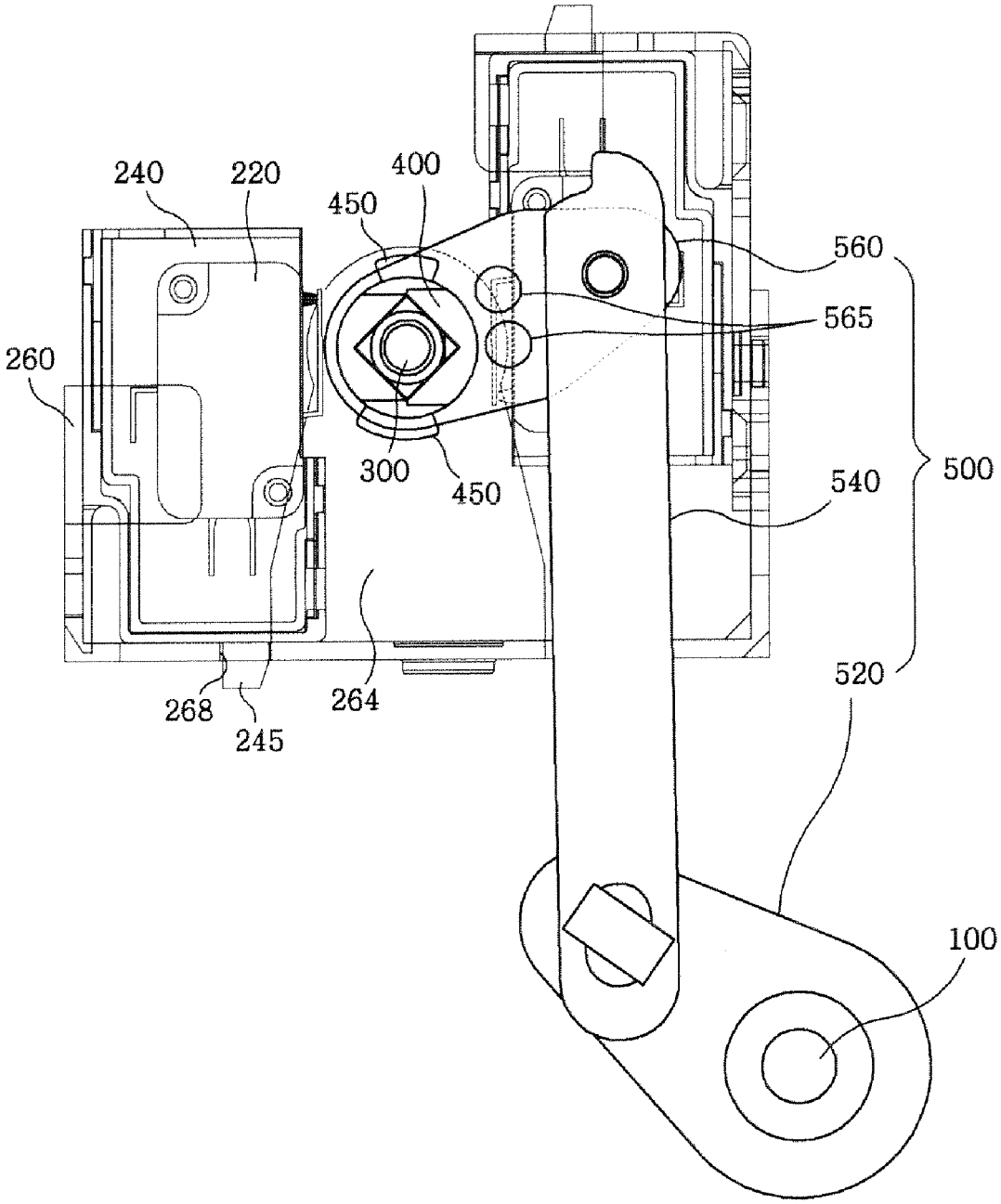
FIG. 7 is a lateral view illustrating a released position of the auxiliary contact apparatus according to the exemplary implementation of FIG. 6.
Figure 8:
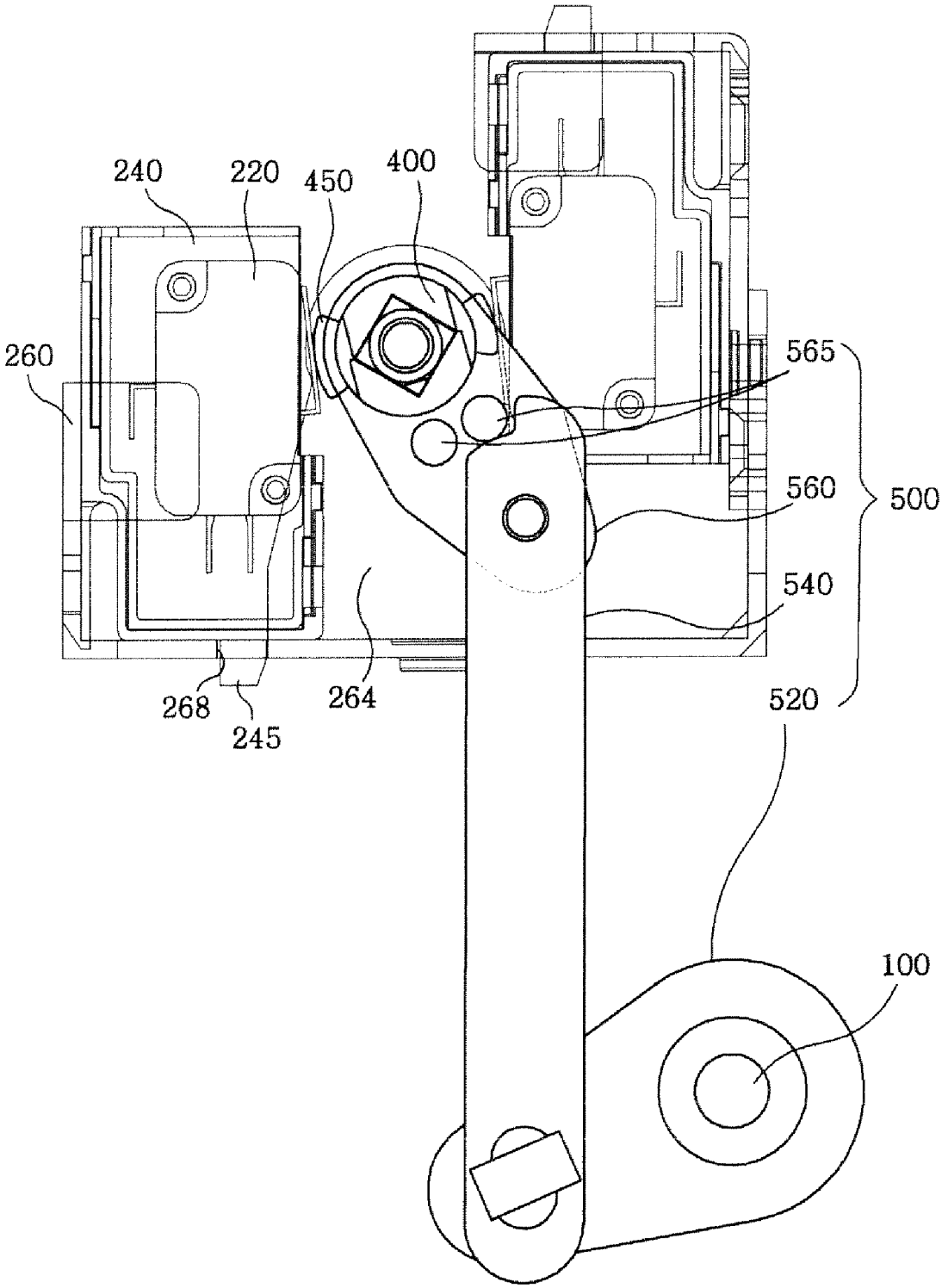
FIG. 8 is a lateral view illustrating a compressed position of the auxiliary contact apparatus according to the exemplary implementation of FIG. 6.

Now, referring to FIGS. 6, 7 and 8, the cam driving shaft 300 is rotatably mounted at a front surface of the ON/OFF switch 220 of the auxiliary contact unit 200. The driving cam 400 is formed along a radial direction of the cam driving shaft 300 for turning on and off the ON/OFF switch by allowing a profile of maximum head 450 to compress and release the ON/OFF switch in response to the rotation of the cam driving shaft 300.

A pair of stationary ribs 264 is formed at the bracket 260 in order for the cam driving shaft 300 to be rotatably mounted at a front surface of the ON/OFF switch 220. The driving cam 400 is rotated along with the rotation of the cam driving shaft 300, and compression or release of the ON/OFF switch by the profile of maximum head 450 allows the external indicator to indicate the connection or interruption of the conducted current.

In the present implementation, a compressed position compressing the ON/OFF switch by the profile of the maximum head 450 shows an interrupted state in which the movable contactor is separated from the stationary contactor, and a released position releasing the compression of the ON/OFF switch by the profile of the maximum head 450 of the driving cam 400 indicates a connected state in which the stationary contactor is connected to the movable contactor.

Figure 11:
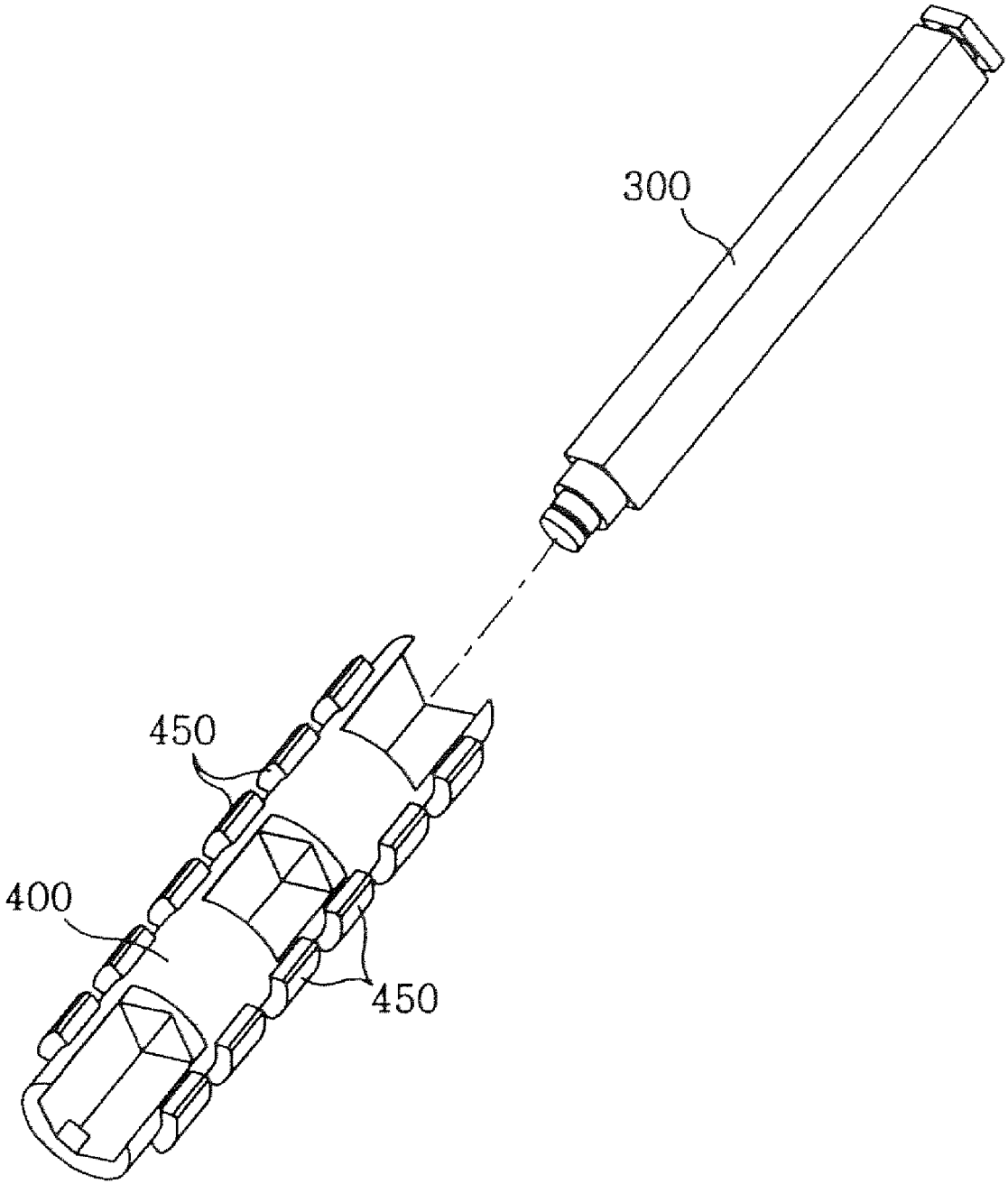
FIG. 11 is a perspective view illustrating a cam driving shaft and a driving cam of the auxiliary contact apparatus according to the exemplary implementation of FIG. 6.

Meanwhile, the cam driving shaft 300 may be integrally formed with the driving cam 400, and as illustrated in FIG. 11, the cam driving shaft may have a multi-angled cylindrical shape, and the driving cam may be rotated along with the cam driving shaft by allowing the cam driving shaft to be hooked up inside a hollow hole. In doing so, the rotational force of the cam driving shaft 300 can be accurately transmitted to the driving cam 400. The easy insertion may enable an easy assembling thereof.

Referring again to FIGS. 6, 7 and 8, the linkage 500 may connect the open/close axis 100 to the cam driving shaft 300 to allow the cam driving shaft 300 to rotate in response to the rotation of the open/close axis 100. Although various methods of link mechanisms are employed to transmit the rotation of the open/close axis 100 to the cam driving shaft 300, the present inventive concept has employed a quadric link mechanism for the linkage 500. In other words, the stationary link includes the open/close axis 100 and the cam driving shaft 300. Now, two rotation links and one coupler link will be described hereinafter.

A drive rotation link 520 is extensively formed from one side of the open/close axis 100 toward the radial direction and rotated along with the open/close axis 100. A coupler link 540 is rotatably coupled at one end thereof to the drive rotation link 520. A driven rotation link 560 is rotatably coupled at one end thereof to the other end of the coupler link 540, and the other end of the driven rotation link 560 is rotatably coupled to the cam driving shaft 300.

In so doing, as shown in FIGS. 7 and 8, each link is rotated in response to the rotation of the open/close axis 100, and as a result, the cam driving shaft 300 is rotated to rotate the driving cam 400 at the same time. The rotation of the driving cam 400 causes the ON/OFF switch of the auxiliary contact unit 200 to be compressed or released, whereby the external indicator is turned on or off to enable the user to check whether the line is conducted or disconnected.

Meanwhile, there may be a disadvantage of a large impact caused by the over-rotation of the open/close axis 100 being applied to articulatory parts of each link, such that there is naturally a need for obviating or minimizing the disadvantage. To this end, the driven rotation link 560 is formed at one surface thereof with a stopper lug 565.

The stopper lug 565 is protrusively formed at one surface of the driven rotation link 560 contacting the coupler link 540 for stopping the rotation of the driven rotation link 560 and the coupler link 540 relative to the compressed position compressing the ON/OFF switch 220 by the profile of the maximum head 450 of the driving cam 400 in response to the rotation of the driven rotation link 560 as illustrated in FIG. 8, and the released position releasing the compression of the ON/OFF switch 220 by the profile of the maximum head 450 of the driving cam as illustrated in FIG. 7.

Although two stopper lugs 565 are formed on the drawing, one stopper lug 565 may be formed in consideration of the rotating radius of each link. It does not matter whether the stopper lug 565 is formed at one surface of each link and at the driven rotation link 560 as well, because the stopper lug 565 has its characteristic of preventing the generation of an over-rotation relative to the compressed position and the released position. The detailed explanation to the compressed position and the released position is omitted as it is redundant.

While the present disclosure has been particularly shown and described with reference to exemplary implementations thereof the general inventive concept is not limited to the above-described implementations. It will be understood by those of ordinary skill in the art that various changes and variations in form and details may be made therein without departing from the spirit and scope of the present invention as defined by the following claims.

INDUSTRIAL APPLICABILITY

The auxiliary contact apparatus of circuit breaker according to the instant inventive concept is such that a linkage is linked to a cam driving shaft and a driving cam to allow an ON/OFF switch being compressed only by the maximum head of the driving cam, thereby preventing an erroneous operation of and damage to the ON/OFF switch caused by over-stroke of the linage mounted at the auxiliary contact apparatus and enhancing reliability despite the repeated opening and closing of the auxiliary contact apparatus.

Furthermore, a driven rotation link may be formed with a stopper lug to enable the linkage to stop at a precise position without running idle when conducted electrical lines are connected or interrupted, i.e., when the ON/OFF switch is compressed and released by the maximum head of the driving cam, thereby minimizing impact transmitted to each link.

Still furthermore, configurations of switch frames and bracket may be changed to solidify the fixation of the ON/OFF switch, whereby a compact auxiliary contact apparatus can be embodied within a cramped space of the circuit breaker.

The invention claimed is:

1. An auxiliary contact apparatus for transmitting a signal to be detected outside of the auxiliary contact apparatus, the signal based on a connection and breaking of a movable contactor and a stationary contactor of a circuit breaker via an open/close mechanism of the circuit breaker, the auxiliary contact apparatus comprising:

an open/close axis configured to be rotated in response to an operation of the open/close mechanism, wherein the open/close mechanism is mounted at a body of the circuit breaker and is configured to connect and interrupt a conducted current;

an auxiliary contact unit configured to be mounted at the body of the circuit breaker and equipped with an ON/OFF switch electrically connected to an external indicator;

a cam driving shaft rotatably mounted at a front side of the ON/OFF switch of the auxiliary contact unit;

a driving cam coupled to the cam driving shaft and extending from the cam driving shaft in a radial direction, the driving cam including a maximum head profile, wherein the driving cam is configured to rotate with the cam driving shaft to turn on the ON/OFF switch by compressing the ON/OFF switch via the maximum head profile when the cam driving shaft is rotated in a first direction and to turn off the ON/OFF switch by releasing the maximum head profile from the ON/OFF switch when the cam driving shaft is rotated in a second direction; and a linkage connecting the open/close axis and the cam driving shaft for rotating the cam driving shaft in response to the rotation of the open/close axis, wherein the linkage includes:

a drive rotation link coupled to an end portion of the open/close axis and extending from the open/close axis in a radial direction, the drive rotation link configured to rotate with the open/close axis when the open/close axis is rotated;

a coupler link having one end portion rotatably coupled to the drive rotation link, the coupler link configured to move when the drive rotation link rotates; and a driven rotation link having one end rotatably coupled to another end of the coupler link that is away from the one end of the coupler link that is coupled to the drive rotation link, and another end coupled to one end portion of the cam driving shaft, the driven rotation link configured to rotate the cam driving shaft when the coupler link moves based on rotation of the drive rotation link.

2. The auxiliary contact apparatus of claim 1, further comprising a stopper lug protruding from a surface of the driven rotation link, the stopper lug configured to contact the coupler link for stopping the rotation of the driven rotation link and movement of the coupler link relative to a compression position, at which the maximum head profile of the driving cam compresses the ON/OFF switch based on the rotation of the driven rotation link, and a release position, at which the maximum head of the driving cam ceases compressing the ON/OFF switch based on the rotation of the driven rotation link.

3. The auxiliary contact apparatus of claim 1, wherein the auxiliary contact unit includes:

a plurality of switch frames configured to accommodate a plurality of ON/OFF switches; and a bracket configured to releasably fix the plurality of switch frames to the body of the circuit breaker, wherein one side of the bracket is configured to be coupled to the body of the circuit breaker.

4. The apparatus of claim 3, wherein:

the bracket includes a pair of stationary ribs; and the one end portion of the cam driving shaft is configured to be rotatably coupled to one stationary rib of the pair of stationary ribs and another end portion of the cam driving shaft is configured to be rotatably coupled to the other stationary rib of the pair of stationary ribs.

5. The auxiliary contact apparatus of claim 3, wherein:

the bracket includes a plurality of stationary grooves;

each of the plurality of switch frames includes a stationary lug configured to be inserted and fixed into one of the plurality of stationary groove; and each of the plurality of switch frames is configured to be slidably coupled to at least one adjacent switch frame.

6. The auxiliary contact apparatus of claim 1, wherein at least a portion of a length of the cam driving shaft has an angled shape positioned within an aperture through a length of the driving cam.

* * * * *